US008559645B2

(12) United States Patent
Corona-Strauss et al.

(10) Patent No.: US 8,559,645 B2
(45) Date of Patent: Oct. 15, 2013

(54) METHOD AND DEVICE FOR SETTING A HEARING DEVICE BY DETECTING LISTENING EFFORT

(75) Inventors: Farah I. Corona-Strauss, Saarbrücken (DE); Matthias Frölich, Suzhou (CN); Matthias Latzel, Eggoslheim (DE); Daniel J. Strauss, Saarbrücken (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 287 days.

(21) Appl. No.: 12/975,434

(22) Filed: Dec. 22, 2010

(65) Prior Publication Data

US 2011/0150253 A1 Jun. 23, 2011

(30) Foreign Application Priority Data

Dec. 22, 2009 (DE) ..... 10 2009 060 093

(51) Int. Cl.
*H04R 25/00* (2006.01)

(52) U.S. Cl.
USPC ..... 381/60; 381/312; 381/314

(58) Field of Classification Search
USPC ..... 381/60, 314, 321, 323, 312
See application file for complete search history.

(56) References Cited

U.S. PATENT DOCUMENTS

| | | | | |
|---|---|---|---|---|
| 5,020,538 | A * | 6/1991 | Morgan et al. | 600/409 |
| 5,023,783 | A * | 6/1991 | Cohen et al. | 600/559 |
| 5,954,667 | A * | 9/1999 | Finkenzeller et al. | 600/544 |
| 6,876,750 | B2 * | 4/2005 | Allred et al. | 381/314 |
| 2004/0152946 | A1 | 8/2004 | Franck | |
| 2006/0153396 | A1 * | 7/2006 | John | 381/60 |
| 2010/0196861 | A1 * | 8/2010 | Lunner | 434/112 |
| 2010/0260366 | A1 | 10/2010 | Heerlein et al. | |
| 2012/0109006 | A1 * | 5/2012 | James et al. | 600/559 |
| 2012/0177233 | A1 * | 7/2012 | Kidmose et al. | 381/314 |

FOREIGN PATENT DOCUMENTS

| | | | |
|---|---|---|---|
| DE | 41 28 172 | A1 | 3/1993 |
| DE | 10 2008 018 041 | A1 | 10/2009 |

OTHER PUBLICATIONS

Strauss, et al. "On the Cognitive Neurodynamics of Listening Effort: A Phase Clustering Analysis of Large-Scale Neural Correlates", 31st Annual International Conference of the IEEE EMBS, Sep. 2-6, 2009, pp. 2078-2081, Minneapolis, MN, USA.

Strauss et al., "Objective estimation of the listening effort: Towards a neuropsychological and neurophysical model", Aug. 20, 2008, Engineering in Medicine and Biology Society, 2008 EMBS 2008. 30th Annual International Conference of the IEEE, IEEE, Picataway, NJ, USA, pp. 1777-1780, XP031508323.

* cited by examiner

*Primary Examiner* — Curtis Kuntz
*Assistant Examiner* — Ryan Robinson
(74) *Attorney, Agent, or Firm* — Laurence A. Greenberg; Werner H. Stemer; Ralph E. Locher

(57) ABSTRACT

A method and device are provided for automatic, recursive adjustment of at least one hearing device worn by a person. The device includes a stimulus generator unit, which emits at least one acoustic stimulus to the hearing device, a signal detection unit with at least one sensor, which detects the neuronal activity of the brain of the person due to the acoustic stimulus, a computation and control unit, which determines a measure of listening effort from the detected neuronal activity and determines changes to hearing device parameters from this. A hearing device control unit changes the hearing device parameters accordingly. The computation and control unit repeatedly prompts the stimulus generator unit to emit a hearing stimulus and the hearing device control unit to change a hearing device parameter, until the measure of listening effort drops below a predefinable first threshold value. This allows hearing devices to be adjusted objectively and automatically in a very robust and reliable manner.

19 Claims, 3 Drawing Sheets

METHOD AND DEVICE FOR SETTING A HEARING DEVICE BY DETECTING LISTENING EFFORT

CROSS-REFERENCE TO RELATED APPLICATION

This application claims the priority, under 35 U.S.C. §119, of German patent application DE 10 2009 060 093.0, filed Dec. 22, 2009; the prior application is herewith incorporated by reference in its entirety.

BACKGROUND OF THE INVENTION

Field of the Invention

The invention relates to a method and a device for the automatic, recursive adjustment of a hearing device worn by a person. The person is given a hearing task and a listening effort associated therewith is detected based on neuropsychological correlates of auditive processing.

The key components of hearing devices are principally an input transducer, an amplifier and an output transducer. The input transducer is normally a sound receiver e.g. a microphone and/or an electromagnetic receiver, e.g. an induction coil. The output transducer is most frequently realized as an electroacoustic transducer e.g. a miniature speaker, or as an electromechanical transducer e.g. a bone conduction earpiece. The amplifier is usually integrated in a signal processing unit. This basic configuration is illustrated in FIG. 1 using the example of a behind-the-ear (BTE) hearing device 1. Two microphones 3 for recording ambient sound are generally built into a hearing device housing 2 to be worn behind the ear. Microphone openings 7 are formed in the hearing device housing 2 above the microphones 3. The sound can reach the microphones 3 in the interior of the hearing device housing 2 through the microphone openings 7. A signal processing unit 4 which is also integrated in the hearing device housing 2 processes and amplifies the microphone signals. The output signal of the signal processing unit 4 is transmitted to a speaker or earpiece 5, which outputs an acoustic signal. Sound is optionally transmitted by way of a non-illustrated sound tube, which is fixed in the auditory canal by way of an otoplastic, to the hearing device wearer's eardrum. Power for the hearing device 1 and in particular for the signal processing unit 4 is supplied by a battery 6 which is also integrated in the hearing device housing 2.

Commonly assigned Patent Application Publication US 20010/0260366 A1 and is German counterpart DE 10 2008 018 041 A1 disclose such a behind-the-ear hearing device with a microphone opening, a volume regulator, a programming socket, a program key with off function, and a battery compartment.

A hearing device is generally adjusted in the dialog between a hearing device wearer and a hearing device acoustician. In this process different test signals are supplied to the hearing device wearer, which the hearing device wearer perceives subjectively, informing the acoustician of his/her impressions. The acoustician compares the perception of the hearing device wearer with the impressions of people with normal hearing in respect of the respective test signal. From the different perceptions the acoustician derives hearing device parameters, which generally result in better adjustment of the hearing device to the hearing device wearer. This procedure is repeated until the hearing-impaired person subjectively experiences a number of test signals in a similar manner to a person with normal hearing.

As shown by German published patent application DE 41 28 172 A1 there has long been a need to replace subjective measurements of hearing capacity with objective measurements and an optionally subsequent correction of hearing device parameters. The most recent research in the field of objective determination of listening effort appears to open up new perspectives in this direction. For example in D. J. Strauss et al., "On the Cognitive Neurodynamics of Listening Effort: A Phase Clustering Analysis of Large-Scale Neural Correlates", 31st Annual International Conference of the IEEE EMBS Minneapolis, Minn., USA, Sep. 2-6, 2009, pages 2048-2081, it is proposed to determine the listening effort from the electrical neuronal activity of the brain by way of mathematical transformation analyses.

SUMMARY OF THE INVENTION

It is accordingly an object of the invention to provide a method and device for setting a hearing device by determining a hearing effort, which overcomes the above-mentioned disadvantages of the heretofore-known devices and methods of this general type and which renders the setting of hearing devices objective, automates the same, and provides an improvement it in respect of neuropsychological variables of hearing processing.

With the foregoing and other objects in view there is provided, in accordance with the invention, a method for the automatic, recursive adjustment of a hearing device worn by a person, wherein a hearing task is set for the person and an associated listening effort is detected, the method which comprises:

supplying at least one acoustic stimulus to the person;

detecting the neuronal activity of the brain of the person in response to the acoustic stimulus;

determining a measure of listening effort from the detected neuronal activity;

changing at least one hearing device parameter as a function of the measure of listening effort determined in step c); and repeating steps a) to d) monitored by a computation and control unit until the measure of listening effort drops below a predefinable first threshold value or is minimized in terms of a defined termination condition that can be predefined in the computation and control unit.

In other words, the objects of the invention are achieved with a method for the automatic, recursive adjustment of a hearing device worn by a person, such adjustment being monitored by a computation and control unit, the person being set a hearing task and an associated listening effort being detected objectively based on neuropsychological correlates of auditive processing. With the method at least one acoustic stimulus is supplied to the person, the neuronal activity of the brain of the person due to the acoustic stimulus is detected, a measure of listening effort is determined from the detected neuronal activity, at least one hearing device parameter is changed by a computation and control unit as a function of the determined measure of listening effort and the method is monitored by the computation and control unit and repeated until the measure of listening effort drops below a predefinable first threshold value or is minimized in terms of a previously defined termination criterion of the control and computation unit. The invention has the advantage that hearing devices can be adjusted objectively and automatically in respect of neuropsychological parameters in a very robust and reliable manner.

In accordance with an added feature of the invention, a number of acoustic stimuli are supplied, the neuronal activities are detected and the detected neuronal activities are subjected to a mathematical analysis for the purpose of feature extraction.

In accordance with an additional feature of the invention, feature extraction can also be defined on the image region of suitable mathematical transformations (e.g. complex time-frequency transformations).

According to the invention, the acoustic stimulus can also include a word sequence, a phonetic syllable sequence or a sound sequence.

In accordance with another feature of the novel method, the neuronal activity of the brain can be detected by means of an electroencephalogram (EEG).

In one preferred embodiment an auditory late response can be determined from the EEG.

It is also possible to determine the inter-trial phase stability obtained by way of the feature of instantaneous phase from complex transformations (e.g. Hilbert, complex wavelet transformation, Gabor frame transformation) of at least two auditory late responses.

It is preferred, in an advantageous development, to use the inter-trial phase stability as the measure of listening effort.

In a further embodiment of the method the neuronal activity of the brain can be detected by means of a magnetoencephalogram (MEG).

In a further embodiment of the method the neuronal activity of the brain can also be detected by means of functional imaging methods (e.g. fMRI, PET, SPECT, fOCT).

The changes to the hearing device parameters can preferably be determined by means of evolutionary algorithms. This allows multidimensional stochastic optimization.

With the above and other objects in view there is also provided, in accordance with the invention, a device for the automatic, recursive adjustment of a hearing device worn by a person, the device comprising:

a stimulus generator unit for emitting at least one acoustic stimulus to the hearing device;

a signal detection unit having at least one sensor configured to detect a neuronal activity of the brain of the person in response to the acoustic stimulus;

a computation and control unit configured to determine a measure of listening effort from the detected neuronal activity and to determine changes to hearing device parameters therefrom; and a hearing device control unit for changing the hearing device parameters;

the computation and control unit repeatedly prompting the stimulus generator unit to emit a hearing stimulus and the hearing device control unit to change a hearing device parameter, until the measure of listening effort drops below a predefinable first threshold value or is minimized in terms of a defined termination condition that can be predefined in the computation and control unit.

In other words, there is also provided a device, which may also be referred to as a system or a configuration, for the automatic, recursive adjustment of at least one hearing device worn by a person, the adjustment being monitored by a computation and control unit. The arrangement comprises a stimulus generator unit, which emits at least one acoustic stimulus to the hearing device, a signal detection unit with at least one sensor, which detects the neuronal activity of the brain of the person due to the acoustic stimulus, a computation and control unit, which determines a measure of listening effort from the detected neuronal activity and determines changes to hearing device parameters from this, and a hearing device control unit, which changes the hearing device parameters. The computation and control unit repeatedly prompts the stimulus generator unit to emit a hearing stimulus and the hearing device control unit to change a hearing device parameter specifically according to an optimization rule, until the measure of listening effort drops below a predefinable first threshold value or is minimized in terms of another termination condition defined previously in the computation and control unit.

In one development of the arrangement the acoustic stimulus can include a word sequence, a phonetic syllable sequence or a sound sequence.

In a further embodiment of the arrangement the signal detection unit and the at least one sensor can detect the neuronal activity of the brain by means of electroencephalography.

The signal detection unit can also determine at least one auditory late response.

The computation and control unit can preferably determine a mean inter-trial phase stability from at least two auditory late responses.

With the system the instantaneous phase determined by way of complex transformations can preferably be used to calculate the inter-trial phase stability, which is used as a feature for quantifying listening effort.

In a further embodiment the signal detection unit and the at least one sensor can detect the neuronal activity of the brain by means of magnetoencephalography.

In a further embodiment of the method the neuronal activity of the brain can also be detected by means of functional imaging methods (e.g. fMRI, PET, SPECT, fOCT).

In accordance with a concomitant feature of the invention, the changes to the hearing device parameters can also be determined by means of an evolutionary algorithm in the computation and control unit.

Other features which are considered as characteristic for the invention are set forth in the appended claims.

Although the invention is illustrated and described herein as embodied in a method and arrangement for setting a hearing device by detecting listening effort, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
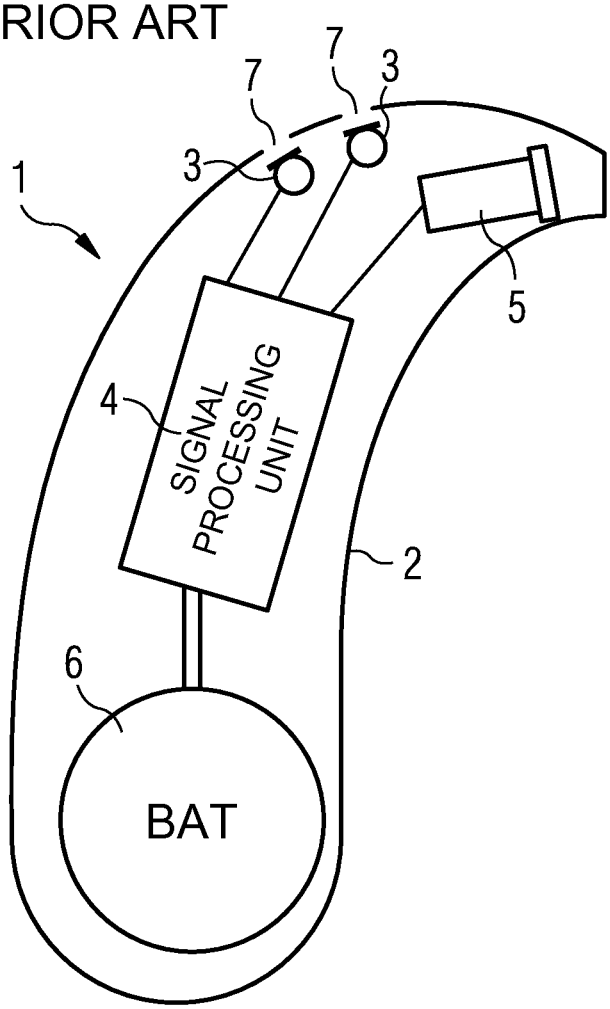
FIG 1 PRIOR ART
FIG. 1 shows a block diagram of a behind-the-ear hearing device according to the prior art.
Figure 2:
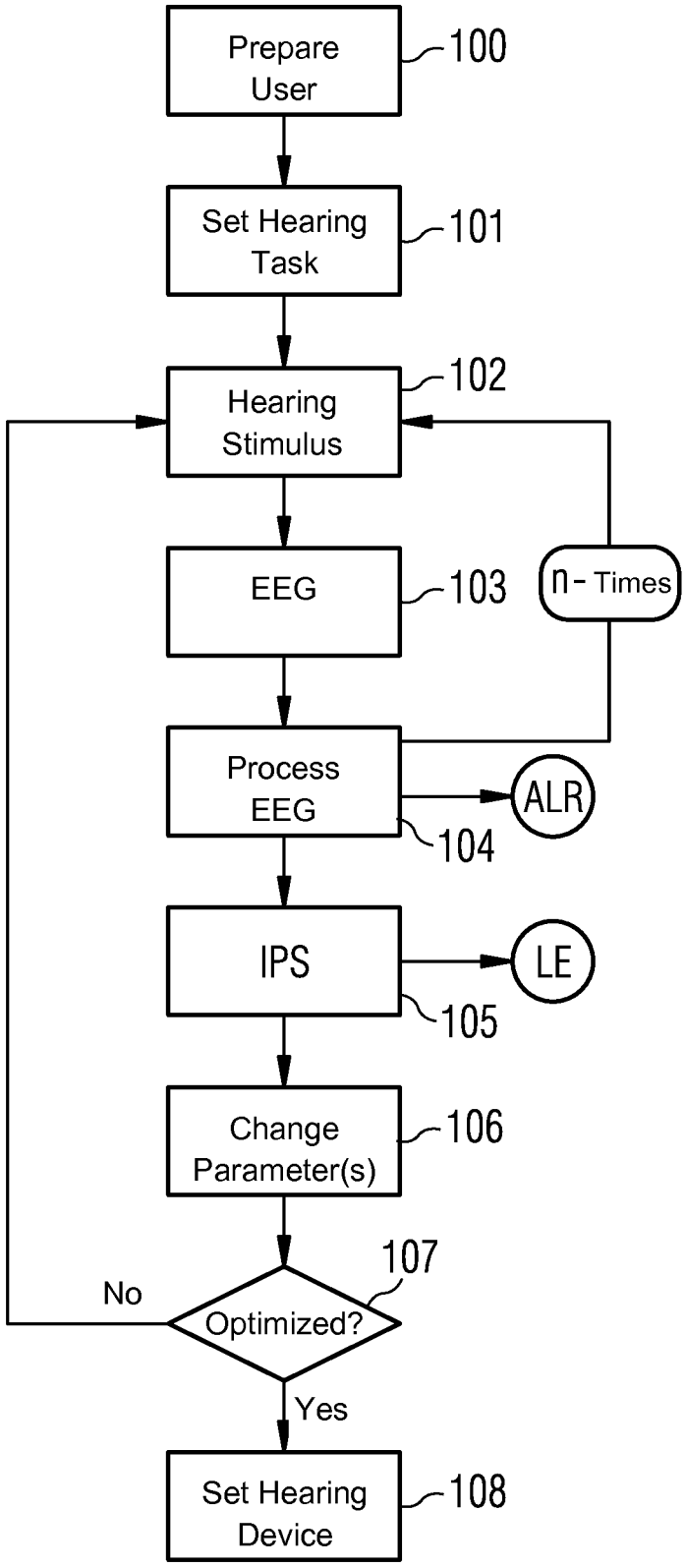
FIG. 2 shows a flow diagram of the method for setting a hearing device by determining listening effort from the IPS.

Referring now once more to the figures in detail and first, particularly, to FIG. 2, there is illustrated a flow diagram of the inventive method for setting at least one hearing device parameter of a hearing device. In the first step 100 a person is prepared for the hearing device setting.

The person is wearing an activated and functional hearing device on each ear, in other words the person wears the hearing devices behind the ear according to the operating instructions. Hearing device parameters, such as channel amplification, compression rate, compression breakpoint, microphone characteristics, interference noise reduction, time constants, are at their base settings, as determined for example by means of an audiogram.

To measure a summed electrical activity of the brain of the person the voltage fluctuations at the head surface of the person have to be recorded by means of electroencephalography (abbreviated to EEG). The electroencephalogram (also abbreviated to EEG) is the graphic representation of these fluctuations. The potential fluctuations are caused by physiological processes of individual brain cells, the changes in the electrical state of which help the brain to process information. The potentials generated by individual neurons are added together according to their specific spatial arrangement so that potential changes distributed over the entire head can be measured. Recording in a number of channels using different electrode combinations is necessary for evaluation purposes. A number of electrodes are therefore applied to the person's scalp.

In the following preparatory step 101 the hearing device acoustician for example sets the person a hearing task, for example identifying the phonetic syllable "pa" from a phonetic syllable sequence containing the phonetic syllables "pa", "da" and "ba", it being possible for the phonetic syllables to occur in any sequence and repetition.

In step 102 the person is supplied with a hearing stimulus in the form of a spoken syllable sequence as mentioned above. It can be supplied directly using the hearing device or indirectly by way of headphones or speakers. With the latter the hearing device picks the hearing stimulus up acoustically. The person tries ("makes an effort") to complete the hearing task ("identifying the phonetic syllable "pa""). Sound sequences or whole sentences can optionally also be supplied.

In step 103, which is carried out parallel to step 102, the neuronal activity of the brain of the person is measured by means of EEG. In other words the electrical potentials between electrodes applied to the scalp are measured.

In step 104 the acoustically evoked potential, in particular the auditory late response ALR, is determined from the EEG.

Steps 102 to 104 are repeated a number of times, to improve the signal to noise ratio of the very weak potentials. In step 105 the ALRs thus determined are used to determine an inter-trial phase stability (IPS) obtained by way of complex transformations and the instantaneous phase, which is a measure of the listening effort LE. The IPS can assume values between "0" and "1", where "1" is a major listening effort LE. The IPS indicates the stability of the instantaneous phase of the ALRs for defined time points.

In the following step 106 at least one hearing device parameter is automatically changed in order to reduce the listening effort LE. This multidimensional optimization problem is preferably resolved with the aid of an evolutionary algorithm running in a computation and control unit.

The optimization progress of the hearing device parameters is checked in step 107, in that every time the hearing device parameters are changed, steps 102 to 106 are repeated and the change in the listening effort LE is determined between two determinations of listening effort LE. If the change is below a predefinable second threshold value, for example 0.2, the method is terminated with step 108 and the hearing device is set optimally in respect of listening effort. Alternatively another, previously defined termination condition in the computation and control unit can detect minimum listening effort (LE).

Other physiological stimuli, for example visual or tactile stimuli, can optionally also be supplied to the person. The person can also optionally signal the subjective completion of the hearing task by way of an actuation unit. This allows the improvement of the hearing device setting to be monitored.

Figure 3:
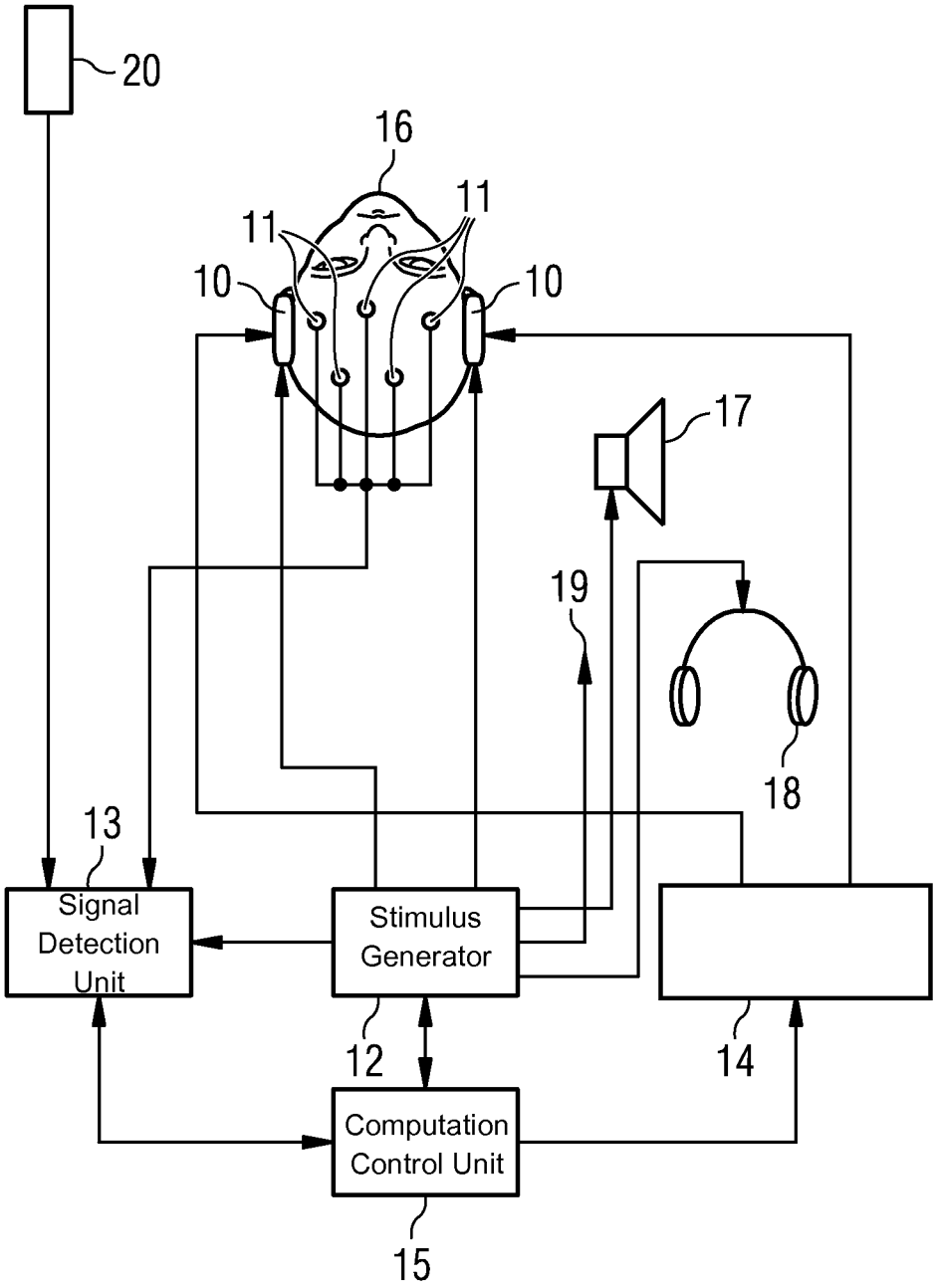
FIG. 3 shows a block diagram of an apparatus for adjusting hearing device parameters with the aid of an EEG.

FIG. 3 shows a simplified block diagram of a device according to the invention for adjusting hearing device parameters with the aid of a determined listening effort. A person 16 wears two hearing devices 10 to assist with a hearing impairment and a number of electrodes 11 on the scalp, which can derive electrical potentials, to measure the neuronal activity of the brain. The electrodes 11 are connected to a signal detection unit 13, which detects the signals picked up by the electrodes 11 in the form of an EEG.

Also connected to the signal detection unit 13 is an actuation unit 20, for example a push button. The person 16 can actuate the actuation unit 20, when they believe they have completed a set hearing task. It is thus possible to check objectively whether set hearing tasks have also actually been completed. One simple hearing task would be to identify a predefined spoken syllable or a sound with a specified sound level.

Acoustic stimuli in the form of sound sequences, phonetic syllables or sentences are supplied to the person 16 by means of a stimulus generator 12 connected to the hearing devices 10. The person 16 must try to complete the hearing task from the stimulus, in other words for example to identify the predefined phonetic syllable. The associated effort is referred to as the listening effort or hearing effort. The hearing stimulus can alternatively also be supplied by way of a speaker 17 or headphones 18. The hearing devices 10 then pick the sound up and emit it in changed and amplified form back to the person 16.

The stimulus generator unit 12 can also emit optional stimuli 19, for example in the form of visual and/or tactile stimuli.

A hearing device control unit 14 can be used to change a very wide range of hearing device parameters, such as channel amplification, compression rate, compression breakpoint, microphone characteristics, interference noise reduction or time constants for example, to allow the hearing devices to be adjusted to the hearing capacity or hearing weakness of the person 16.

A computation and control unit 15, which is connected to the stimulus generator unit 12, the hearing device control unit 14 and the signal detection unit 13, controls these units and determines listening effort from the recorded signal profiles of the EEG. ALRs are preferably determined from a series of tests and the mean IPS is preferably calculated from these. The mean IPS is a very robust and reliable measure of listening effort. The mean IPS is now used in a differential evolution algorithm of the computation and control unit 15 to determine the change to the hearing device parameters. Every time the hearing device parameters are changed, new hearing stimuli are supplied until the difference or differences between the determined listening efforts only deviate from one another by a second threshold value.

The mean IPS can assume values between "0" and "1", the second threshold value is preferably "0.2". The differential evolution is a mathematical method for optimizing a multidimensional function.

The invention claimed is:

1. A method for the automatic, recursive adjustment of a hearing device worn by a person, wherein a hearing task is set for the person and an associated listening effort is detected, the method which comprises:

a) supplying at least one acoustic stimulus to the person;

b) detecting the neuronal activity of the brain of the person in response to the acoustic stimulus;

c) determining a measure of listening effort from the detected neuronal activity;

d) changing at least one hearing device parameter as a function of the measure of listening effort determined in step c); and e) repeating steps a) to d) monitored by a computation and control unit until the measure of listening effort drops below a predefinable first threshold value or is minimized in terms of a defined termination condition that can be predefined in the computation and control unit.

2. The method according to claim 1, which comprises:

repeating steps a) and b); and performing mathematical analysis of the detected neuronal activities for an improved extraction of neuropsychological correlates of listening effort.

3. The method according to claim 2, which comprises also defining the extraction on an image region of suitable mathematical transformations.

4. The method according to claim 3, which comprises choosing complex time/frequency transformations as suitable mathematical transformations.

5. The method according to claim 1, wherein the acoustic stimulus includes a word sequence, a phonetic syllable sequence, or a sound sequence.

6. The method according to claim 1, which comprises detecting the neuronal activity of the brain by an electroencephalogram.

7. The method according to claim 6, which comprises determining an auditory late response from the electroencephalogram.

8. The method according to claim 7, which comprises determining a mean inter-trial phase stability from at least two auditory late responses.

9. The method according to claim 8, wherein the inter-trial phase stability is the measure of listening effort.

10. The method according to claim 1, which comprises detecting the neuronal activity of the brain by a magnetoencephalogram.

11. The method according to claim 1, which comprises determining the changes to the hearing device parameters by way of a differential evolution algorithm.

12. A device for the automatic, recursive adjustment of a hearing device worn by a person, the device comprising:

a stimulus generator unit for emitting at least one acoustic stimulus to the hearing device;

a signal detection unit having at least one sensor configured to detect a neuronal activity of the brain of the person in response to the acoustic stimulus;

a computation and control unit configured to determine a measure of listening effort from the detected neuronal activity and to determine changes to hearing device parameters therefrom; and a hearing device control unit for changing the hearing device parameters, said computation and control unit repeatedly prompting said stimulus generator unit to emit a hearing stimulus and said hearing device control unit to change a hearing device parameter, until the measure of listening effort drops below a predefinable first threshold value or is minimized in terms of a defined termination condition that can be predefined in the computation and control unit.

13. The device according to claim 12, wherein the acoustic stimulus includes a word sequence, a phonetic syllable sequence, or a sound sequence.

14. The device according to claim 12, wherein said signal detection unit and said at least one sensor are configured to detect the neuronal activity of the brain by means of electroencephalography.

15. The device according to claim 14, wherein said signal detection unit is configured to determine at least one auditory late response.

16. The device according to claim 15, wherein said computation and control unit determines an inter-trial phase stability from its instantaneous phase from at least two auditory late responses.

17. The device according to claim 16, wherein the inter-trial phase stability is the measure of listening effort.

18. The device according to claim 12, wherein said signal detection unit and said at least one sensor detect the neuronal activity of the brain by means of magnetoencephalography.

19. The device according to claim 12, wherein said computation and control unit is configured to determine the changes to the hearing device parameters by way of a differential evolution algorithm.

* * * * *